US006078113A

United States Patent [19]

True et al.

[11] Patent Number: 6,078,113

[45] Date of Patent: Jun. 20, 2000

[54] POWER SOCKET WITH ILLUMINATED PLUG BLADE SLOTS

[76] Inventors: Mark E. True; Richard A. Witt, both of 3591 Morrow Rd., Murphy, N.C. 28906

[21] Appl. No.: 09/243,521

[22] Filed: Feb. 1, 1999

[51] Int. Cl.[7] ..... G08B 5/00

[52] U.S. Cl. ..... 307/147; 340/656; 362/848; 362/95; 362/231; 439/490; 439/491

[58] Field of Search ..... 340/657, 656; 307/147, 149; 362/952, 231, 848; 349/63; 116/335; 174/53, 66, 55; 439/490, 491, 488; 220/241, 3.8

[56] References Cited

U.S. PATENT DOCUMENTS

| | | | |
|---|---|---|---|
| 2,045,199 | 6/1936 | Petersen | 177/311 |
| 2,612,597 | 9/1952 | Sherrard | 240/2 |
| 2,749,428 | 6/1956 | McCarthy | 240/2 |
| 3,265,888 | 8/1966 | Adolphson, Jr. | 240/73 |
| 3,588,489 | 6/1971 | Gaines | 240/2 |
| 3,895,225 | 7/1975 | Prior | 240/2 |
| 4,000,405 | 12/1976 | Horwinski | 240/2 |
| 5,672,066 | 9/1997 | Yeung | 439/107 |

*Primary Examiner*—Jeffrey Gaffin
*Assistant Examiner*—Andre Henry
*Attorney, Agent, or Firm*—Joseph N. Breaux

[57] ABSTRACT

A power socket with illuminated plug blade slots that includes an illumination mechanism for illuminating the interior area of each plug blade slot. The illumination mechanism has two color outputs for illuminating the neutral plug blade slot a first color and illuminating the hot plug blade slot a second color.

3 Claims, 2 Drawing Sheets

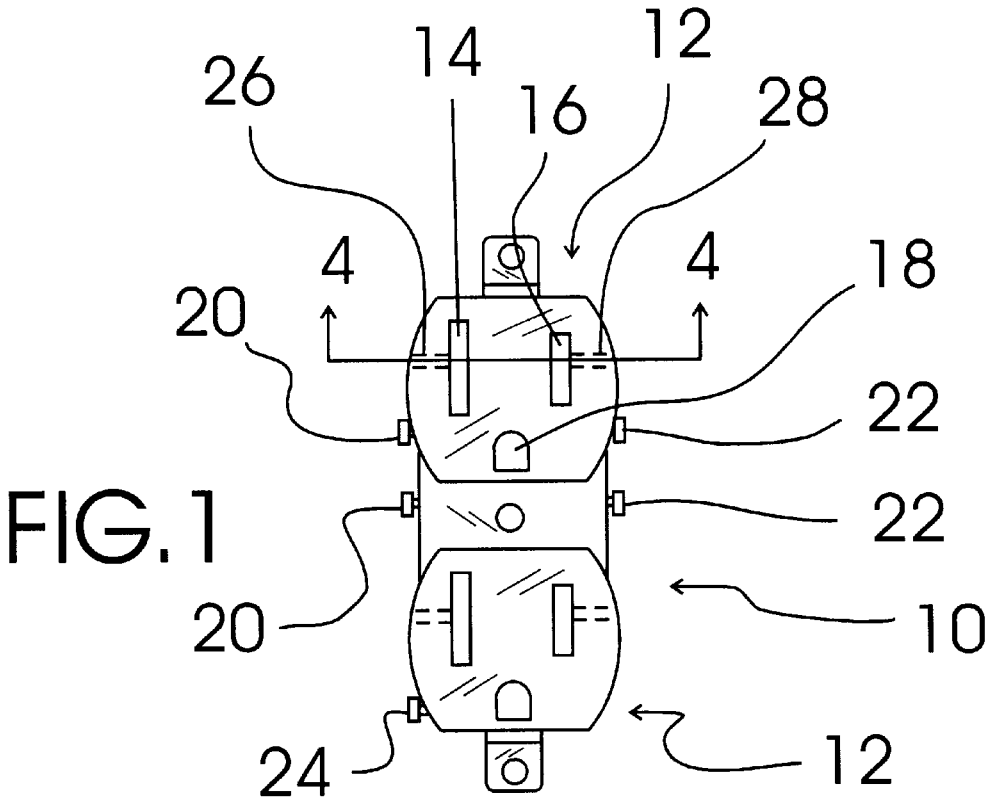
FIG. 1
FIG. 2
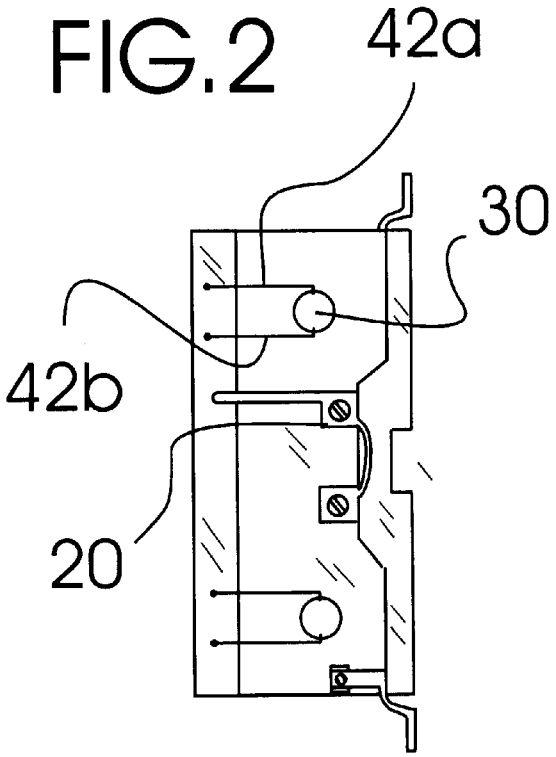
FIG. 3
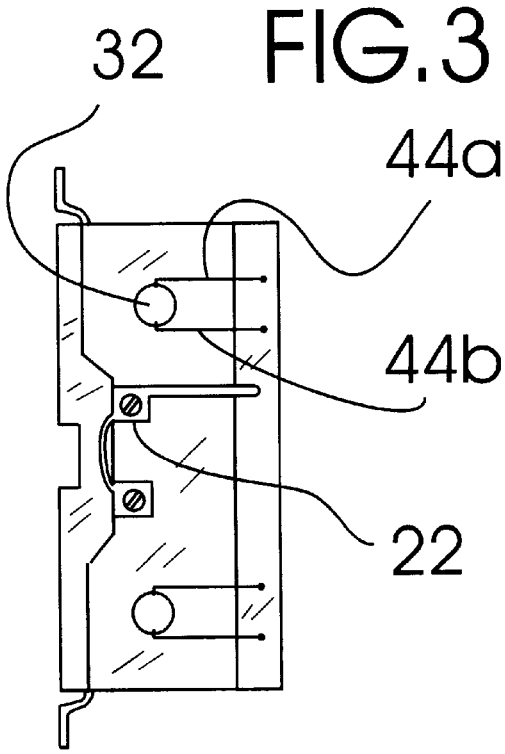

POWER SOCKET WITH ILLUMINATED PLUG BLADE SLOTS

TECHNICAL FIELD

The present invention relates to electrical power sockets and more particularly to a power socket with illuminated plug blade slots that includes a power socket structure including a hot plug blade slot, a neutral plug blade slot, a ground plug blade slot, a hot wire connecting terminal in electrical connection with a hot blade contact positioned within the hot plug blade slot, a neutral wire connecting terminal in electrical connection with a neutral blade contact positioned within the neutral plug blade slot, a ground wire connecting terminal in electrical connection with a ground blade contact positioned within the ground plug blade slot, a first color diode passageway Formed into the power socket structure into direct connection with the hot plug blade slot, a second color diode passageway formed into the power socket structure into direct connection with the neutral plug blade slot, a first color diode installed within the first color diode passageway and having two first color diode terminals, a second color diode installed within the second color diode passageway and having two diode terminals, and a diode drive circuit including a rectifier circuit in connection with the hot wire connecting terminal and the neutral wire connecting terminal and a voltage divider network having two resistance legs and having one resistance leg wired in parallel with the first color and second color diode.

BACKGROUND ART

It is often difficult to locate the plug blade slots of a power socket when it is positioned in a dark area, such as behind a piece of furniture. It would be a benefit, therefore, to have a power socket that included an illumination mechanism for illuminating the interior area of each plug blade slot so that a user could readily identify the locations of the plug blade slots. Because the plug blade slots are keyed to hot and neutral plug blades, it would be further benefit to have an illumination mechanism having two color outputs for illuminating the neutral plug blade slot a first color and illuminating the hot plug blade slot a second color so that the user could properly orient the plug blades for insertion into the proper blade slot.

GENERAL SUMMARY DISCUSSION OF INVENTION

It is thus an object of the invention to provide a power socket with illuminated plug blade slots.

It is a further object of the invention to provide a power socket with illuminated plug blade slots that includes an illumination mechanism for illuminating the interior area of each plug blade slot.

It is a still further object of the invention to provide a power socket with illuminated plug blade slots that includes an illumination mechanism having two color outputs for illuminating the neutral plug blade slot a first color and illuminating the hot plug blade slot a second color.

It is a still further object of the invention to provide a power socket with illuminated plug blade slots that includes a power socket structure including a hot plug blade slot, a neutral plug blade slot, a ground plug blade slot, a hot wire connecting terminal in electrical connection with a hot blade contact positioned within the hot plug blade slot, a neutral wire connecting terminal in electrical connection with a neutral blade contact positioned within the neutral plug blade slot, a ground wire connecting terminal in electrical connection with a ground blade contact positioned within the ground plug blade slot, a first color diode passageway formed into the power socket structure into direct connection with the hot plug blade slot, a second color diode passageway formed into the power socket structure into direct connection with the neutral plug blade slot, a first color diode installed within the first color diode passageway and having two first color diode terminals, a second color diode installed within the second color diode passageway and having two diode terminals, and a diode drive circuit including a rectifier circuit in connection with the hot wire connecting terminal and the neutral wire connecting terminal and a voltage divider network having two resistance legs and having one resistance leg wired in parallel with the first color and second color diode.

It is a still further object of the invention to provide a power socket with illuminated plug blade slots that accomplishes all or some of the above objects in combination.

Accordingly, a power socket with illuminated plug blade slots is provided. The power socket with illuminated plug blade slots includes a power socket structure including a hot plug blade slot, a neutral plug blade slot, a ground plug blade slot, a hot wire connecting terminal in electrical connection with a hot blade contact positioned within the hot plug blade slot, a neutral wire connecting terminal in electrical connection with a neutral blade contact positioned within the neutral plug blade slot, a ground wire connecting terminal in electrical connection with a ground blade contact positioned within the ground plug blade slot, a first color diode passageway formed into the power socket structure into direct connection with the hot plug blade slot, a second color diode passageway formed into the power socket structure into direct connection with the neutral plug blade slot, a first color diode installed within the first color diode passageway and having two first color diode terminals, a second color diode installed within the second color diode passageway and having two diode terminals, and a diode drive circuit including a rectifier circuit in connection with the hot wire connecting terminal and the neutral wire connecting terminal and a voltage divider network having two resistance legs and having one resistance leg wired in parallel with the first color and second color diode.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a front plan view of an exemplary embodiment of the power socket of the present invention showing two power socket structures each including a hot plug blade slot, a neutral plug blade slot, a ground plug blade slot, a hot wire connecting terminal, a neutral wire connecting terminal, a ground wire connecting terminal, a red diode passageway (shown in dashed lines) in direct connection with the hot plug blade slot, and a blue diode passageway (shown in dashed lines) in direct connection with the neutral plug blade slot.

FIG. 2 is a right side plan view of the power socket of FIG. 1 showing the two electrically connected hot wire connecting terminals in electrical connection with the diode drive circuit, the ground wire connecting terminal, the two red diodes each inserted into one of the red diode passageways and having two terminals in connection with the diode drive circuit.

FIG. 3 is a left side plan view of the power socket of FIG. 1 showing the two electrically connected neutral wire connecting terminals in electrical connection with the diode drive circuit, the two blue diodes each inserted into one of the blue diode passageways and having two terminals in connection with the diode drive circuit.

EXEMPLARY MODE FOR CARRYING OUT THE INVENTION

Figure 4:
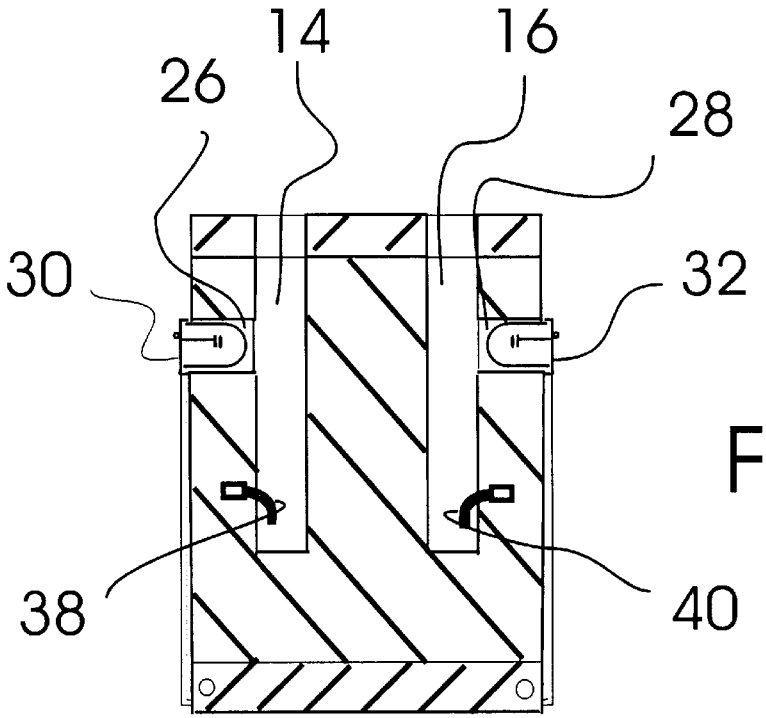
FIG. 4 is a cross sectional view of the power socket of FIG. 1 through the line 4—4 showing a hot plug blade slot, a neutral plug blade slot, a red diode passageway in direct connection with the hot plug blade slot, a red diode inserted into the red diode passageway, a hot blade contact positioned within the hot plug blade slot, a blue diode passageway in direct connection with the neutral plug blade slot, a blue diode inserted into the blue diode passageway, and a neutral blade contact positioned within the neutral plug blade slot.

FIG. 1 shows an exemplary embodiment of the power socket of the present invention generally designated 10. Power socket 10 includes two power socket structures, each generally designated 12. Each power socket structure 12 includes a hot plug blade slot 14, a neutral plug blade slot 16, a ground plug blade slot 18, a hot wire connecting terminal 20, a neutral wire connecting terminal 22, a ground wire connecting terminal 24, a red diode passageway 26 (shown in dashed lines) in direct connection with hot plug blade slot 14, a blue diode passageway 28 in direct connection with neutral plug blade slot 14, a red diode 30 (FIG. 2), a blue diode 32 (FIG. 3), and a diode drive circuit 34 (FIG. 5).

Referring to FIG. 4, red diode 30 is installed within red diode passageway and emits red light into hot plug blade slot 14. A hot blade contact 38 is positioned within hot plug blade slot 14. Referring to FIG. 2, red diode 30 has two red diode terminals 42*a*, 42*b*.

Referring hack to FIG. 4, blue diode 32 is installed within blue diode passageway 28 and emits blue light into neutral plug blade slot 16. A neutral blade contact 40 is positioned within neutral plug blade slot 16. Referring to FIG. 3, blue diode 32 has two blue diode terminals 44*a*,44*b*.

Figure 5:
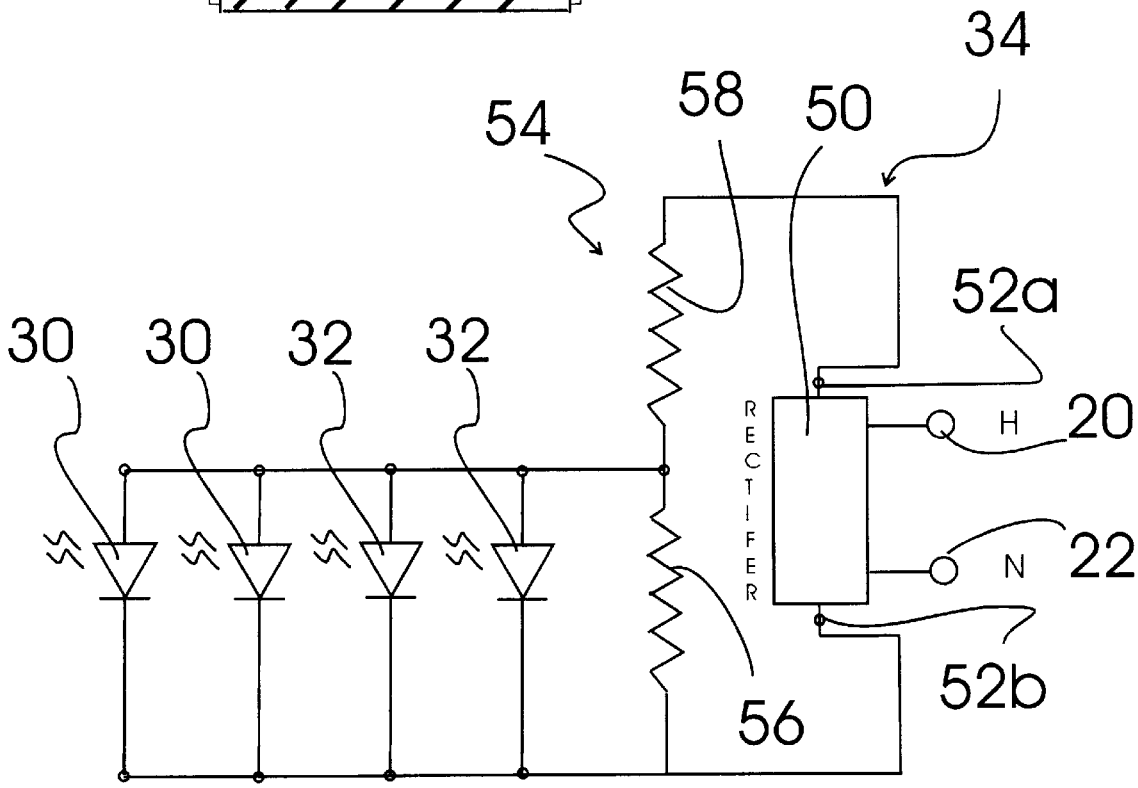
FIG. 5 is a schematic diagram showing the two red diodes, the two blue diodes and the diode drive circuit including the rectifier circuit and the voltage divider resistor network.

Referring to FIG. 5, each blue diode 32 and each red diode 30 are in electrical connection with diode drive circuit 34. Diode drive circuit 34 includes a rectifier 50 having inputs wired between hot terminal 20 and neutral terminal 22 and outputs 52*a*,52*b* wired across a resistance voltage divider network, generally designated 54, having a low voltage leg 56 and a high voltage leg 58. Red diodes 30 and blue diodes 32 are wired in parallel with low voltage leg 56 and are illuminated whenever power is connected to hot terminal 20 and neutral terminal 22.

It can be seen from the preceding description that a power socket with illuminated plug blade slots has been provided that includes an illumination mechanism for illuminating the interior area of each plug blade slot; an illumination mechanism having two color outputs for illuminating the neutral plug blade slot a first color and illuminating the hot plug blade slot a second color; and a power socket structure including a hot plug blade slot, a neutral plug blade slot, a ground plug blade slot, a hot wire connecting terminal in electrical connection with a hot blade contact positioned within the hot plug blade slot, a neutral wire connecting terminal in electrical connection with a neutral blade contact positioned within the neutral plug blade slot, a ground wire connecting terminal in electrical connection with a ground blade contact positioned within the ground plug blade slot, a first color diode passageway formed into the power socket structure into direct connection with the hot plug blade slot, a second color diode passageway formed into the power socket structure into direct connection with the neutral plug blade slot, a first color diode installed within the first color diode passageway and having two first color diode terminals, a second color diode installed within the second color diode passageway and having two diode terminals, and a diode drive circuit including a rectifier circuit in connection with the hot wire connecting terminal and the neutral wire connecting terminal and a voltage divider network having two resistance legs and having one resistance leg wired in parallel with the first color and second color diode.

It is noted that the embodiment of the power socket with illuminated plug blade slots described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A power socket with illuminated plug blade slots comprising:

a power socket structure including:

a hot plug blade slot, a neutral plug blade slot, a ground plug blade slot, a hot wire connecting terminal in electrical connection with a hot blade contact positioned within the hot plug blade slot, a neutral wire connecting terminal in electrical connection with a neutral blade contact positioned within the neutral plug blade slot, a ground wire connecting terminal in electrical connection with a ground blade contact positioned within the ground plug blade slot, a first color diode passageway formed into the power socket structure into direct connection with the hot plug blade slot, a second color diode passageway formed into the power socket structure into direct connection with the neutral plug blade slot, a first color diode installed within the first color diode passageway and having two first color diode terminals, a second color diode installed within the second color diode passageway and having two diode terminals, and a diode drive circuit including a rectifier circuit in connection with the hot wire connecting terminal and the neutral wire connecting terminal and a voltage divider network having two resistance legs and having one resistance leg wired in parallel with the first color diode and the second color diode.

2. The power socket with illuminated plug blade slots of claim 1 wherein:

said first color diode emits red light.

3. The power socket with illuminated plug blade slots of claim 2 wherein:

said second color diode emits blue light.

* * * * *